US010559162B2

(12) United States Patent
Ghia et al.

(10) Patent No.: US 10,559,162 B2
(45) **Date of Patent: *Feb. 11, 2020**

(54) METHOD AND SYSTEM FOR DETERMINING AND DISPLAYING INFORMATION ON THE PRIZE VALUE OF INSTANT LOTTERY TICKETS OFFERED FOR SALE IN MULTI-BIN ARRAYS

(71) Applicant: Scientific Games International, Inc., Newark, DE (US)

(72) Inventors: Ajay J. Ghia, Cumming, GA (US); William F. Behm, Roswell, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/556,418

(22) Filed: Aug. 30, 2019

(65) Prior Publication Data

US 2019/0385399 A1 Dec. 19, 2019

Related U.S. Application Data

(63) Continuation of application No. 15/199,133, filed on Jun. 30, 2016, now Pat. No. 10,403,088.

(51) Int. Cl.
*G07F 17/32* (2006.01)

(52) U.S. Cl.
CPC ..... *G07F 17/323* (2013.01); *G07F 17/329* (2013.01)

(58) Field of Classification Search
CPC ... G07F 17/323; G07F 17/3232; G07F 17/329
See application file for complete search history.

(56) References Cited

U.S. PATENT DOCUMENTS

2001/0034263 A1* 10/2001 Roberts ..... B26F 3/002 463/17
2008/0026811 A1* 1/2008 White ..... G07F 17/32 463/17
2016/0012680 A1* 1/2016 Katz ..... G07F 17/3248 463/25

* cited by examiner

*Primary Examiner* — Werner G Garner
(74) *Attorney, Agent, or Firm* — Dority & Manning, P.A.

(57) ABSTRACT

A system and associated method are provided for dispensing lottery tickets at a retail establishment. Lottery tickets are provided for purchase from a dispenser array in the retail establishment, the dispenser array including a plurality of separate bins having a pack of different respective lottery tickets stored therein. The dispenser array is in communication with a central lottery server. Upon loading of a ticket pack into the bins, a code associated with the ticket pack is scanned and transmitted to the central lottery server. With the central lottery server, a total minimum winning prize amount of the lottery tickets in the pack associated with each bin is determined, and a message is generated and transmitted as a function of this minimum total prize amount of the lottery tickets in all of the bins in the array, with the message being displayed to consumers at the retail establishment.

9 Claims, 5 Drawing Sheets

"7" (INSTANT GAME NO. XXX)
PRIZE STRUCTURE
MARCH 3, 2016 - VERSION A 300,000 $10 TICKETS $3,000,000 REVENUE $ 2,070,000 PRIZE FUND 69.00%

Match any of YOUR NUMBERS to any of the WINNING NUMBERS, win prize shown for that number. Get a "7" symbol and win TRIPLE the prize shown. Get a "RED 7" symbol and win 10 TIMES the prize shown!

| # OF WINS | WIN WITH PRIZE(S) OF: | WIN: | ODDS OF 1 IN: | WINNERS IN 30 (PER BOOK*) | WINNERS IN 30,000 (PER POOL) | WINNERS IN 10 POOLS | PRIZE COST | PERCENT OF PRIZE FUND** | |
|---|---|---|---|---|---|---|---|---|---|
| 2 | $5 x2 | $10 | 12.50 | 2.40 | 2,400 | 24,000 | $ 240,000 | 11.59% | |
| 1 | $10 | $10 | 15.00 | 2.00 | 2,000 | 20,000 | $ 200,000 | 9.66% | 21.26% |
| 3 | $5 x3 | $15 | 75.00 | 0.40 | 400 | 4,000 | $ 60,000 | 2.90% | |
| 2 | $5 + $10 | $15 | 75.00 | 0.40 | 400 | 4,000 | $ 60,000 | 2.90% | |
| 1 | $5 w/7 | $15 | 150.00 | 0.20 | 200 | 2,000 | $ 30,000 | 1.45% | |
| 1 | $15 | $15 | 75.00 | 0.40 | 400 | 4,000 | $ 60,000 | 2.90% | 10.14% |
| 2 | $5 + $15 | $20 | 75.00 | 0.40 | 400 | 4,000 | $ 80,000 | 3.86% | |
| 2 | $5 + $5 w/7 | $20 | 150.00 | 0.20 | 200 | 2,000 | $ 40,000 | 1.93% | |
| 3 | $5 x2 + $10 | $20 | 150.00 | 0.20 | 200 | 2,000 | $ 40,000 | 1.93% | |
| 1 | $20 | $20 | 150.00 | 0.20 | 200 | 2,000 | $ 40,000 | 1.93% | 9.66% |
| 5 | $5 x4 + $10 | $30 | 75.00 | 0.40 | 400 | 4,000 | $ 120,000 | 5.80% | |
| 2 | $15 x2 | $30 | 150.00 | 0.20 | 200 | 2,000 | $ 60,000 | 2.90% | |
| 1 | $10 w/7 | $30 | 150.00 | 0.20 | 200 | 2,000 | $ 60,000 | 2.90% | |
| 1 | $30 | $30 | 150.00 | 0.20 | 200 | 2,000 | $ 60,000 | 2.90% | 14.49% |
| 4 | $5 + $10 + $15 + $20 | $50 | 75.00 | 0.40 | 400 | 4,000 | $ 200,000 | 9.66% | |
| 3 | $5 + $10 w/7 + $15 | $50 | 75.00 | 0.40 | 400 | 4,000 | $ 200,000 | 9.66% | |
| 1 | $5 w/RED 7 | $50 | 150.00 | 0.20 | 200 | 2,000 | $ 100,000 | 4.83% | 24.15% |
| 2 | $5 w/RED 7 + $50 | $100 | 600.00 | - | 50 | 500 | $ 50,000 | 2.42% | |
| 4 | $5 + $15 w/7 + $20 + $30 | $100 | 600.00 | - | 50 | 500 | $ 50,000 | 2.42% | |
| 8 | $5 x4 + $10 + $20 x2 + $30 | $100 | 600.00 | - | 50 | 500 | $ 50,000 | 2.42% | |
| 3 | $10 + $20 w/7 + $30 | $100 | 666.67 | - | 45 | 450 | $ 45,000 | 2.17% | |
| 2 | $10 + $30 w/7 | $100 | 666.67 | - | 45 | 450 | $ 45,000 | 2.17% | |
| 1 | $10 w/RED 7 | $100 | 666.67 | - | 45 | 450 | $ 45,000 | 2.17% | |
| 1 | $100 | $100 | 666.67 | - | 45 | 450 | $ 45,000 | 2.17% | 15.94% |
| 20 | $10 w/RED 7 + $20 + $30 + $50 x17 | $1,000 | 75,000.00 | - | - | 4 *** | $ 4,000 | 0.19% | |
| 6 | $50 w/RED 7 + $100 x5 | $1,000 | 100,000.00 | - | - | 3 *** | $ 3,000 | 0.14% | |
| 1 | $1,000 | $1,000 | 100,000.00 | - | - | 3 *** | $ 3,000 | 0.14% | 0.48% |
| 1 | $40,000 | $40,000 | 150,000.00 | - | - | 2 *** | $ 80,000 | 3.86% | 3.86% |
| | | TOTAL | 3.29 | 8.80 | 9,130 | 91,312 | $ 2,070,000 | 100.00% | 100.00% |

7 = Triple prize shown
RED 7 = Win 10 times the prize shown.

| Consolidated odds are 1 in: | | | |
|---|---|---|---|
| $10 | = 6.82 | $50 | = 30.00 |
| $15 | = 21.43 | $100 | = 90.91 |
| $20 | = 30.00 | $1,000 | = 30,000.00 |
| $30 | = 30.00 | | |

Fig. 6A

"7" (INSTANT GAME NO. XXX)
PRIZE STRUCTURE
MARCH 3, 2016 - VERSION A

* A Guaranteed Low-End Prize Structure (GLEPS) will be used in each book of 30 tickets. Approximately 1/5 of the books will use Low-End Prize Structures A, B, C, D and E.
** Numbers are rounded.
*** Exact quantity of winners must be delivered to the Lottery.

| PRIZE | A | B | C | D | E |
|---|---|---|---|---|---|
| $10 $5 x2 | 1 = $10 | 3 = $30 | 3 = $30 | 3 = $30 | 2 = $20 |
| $10 10 | 1 = $10 | 2 = $20 | 2 = $20 | 2 = $20 | 3 = $30 |
| $15 $5 x3 | 0 = $0 | 1 = $15 | 1 = $15 | 0 = $0 | 0 = $0 |
| $15 $5 + $10 | 1 = $15 | 0 = $0 | 0 = $0 | 1 = $15 | 0 = $0 |
| $15 $5 w/7 | 1 = $15 | 0 = $0 | 0 = $0 | 0 = $0 | 0 = $0 |
| $15 15 | 1 = $15 | 0 = $0 | 0 = $0 | 0 = $0 | 1 = $15 |
| $20 $5 + $15 | 1 = $20 | 0 = $0 | 1 = $20 | 0 = $0 | 0 = $0 |
| $20 $5 + $5 w/7 | 0 = $0 | 0 = $0 | 0 = $0 | 1 = $20 | 0 = $0 |
| $20 $5 x2 + $10 | 0 = $0 | 0 = $0 | 0 = $0 | 0 = $0 | 1 = $20 |
| $20 20 | 0 = $0 | 1 = $20 | 0 = $0 | 0 = $0 | 0 = $0 |
| $30 $5 x4 + $10 | 1 = $30 | 0 = $0 | 0 = $0 | 0 = $0 | 1 = $30 |
| $30 $15 x2 | 0 = $0 | 1 = $30 | 0 = $0 | 0 = $0 | 0 = $0 |
| $30 $10 w/7 | 0 = $0 | 0 = $0 | 1 = $30 | 0 = $0 | 0 = $0 |
| $30 30 | 0 = $0 | 0 = $0 | 0 = $0 | 1 = $30 | 0 = $0 |
| $50 $5 + $10 + $15 + $20 | 1 = $50 | 0 = $0 | 0 = $0 | 0 = $0 | 1 = $50 |
| $50 $5 + $10 w/7 + $15 | 0 = $0 | 1 = $50 | 0 = $0 | 1 = $50 | 0 = $0 |
| $50 $5 w/RED 7 | 0 = $0 | 0 = $0 | 1 = $50 | 0 = $0 | 0 = $0 |
| TOTAL | 8 $165 | 9 $165 | 9 $165 | 9 $165 | 9 $165 |

Fig. 6B

METHOD AND SYSTEM FOR DETERMINING AND DISPLAYING INFORMATION ON THE PRIZE VALUE OF INSTANT LOTTERY TICKETS OFFERED FOR SALE IN MULTI-BIN ARRAYS

PRIORITY APPLICATION

The present application is a Continuation Application of U.S. application Ser. No. 15/199,133, filed Jun. 30, 2016.

BACKGROUND

Historically, instant lottery tickets (e.g., scratch-off lottery tickets) are offered for sale in games where the total number of winners and total prize value are known and advertised to players based on the total number of tickets produced for each game. Of course, not all of the tickets are on sale simultaneously. Once delivered to a lottery, tickets are stored in a warehouse and delivered to retailers on a periodic basis, as sales of the game proceed. Thus, some tickets remain in a lottery warehouse, some reside in delivery vehicles and others are delivered to retail locations but are not yet on sale. Today, a lottery typically does not know which tickets are actually on sale in retail locations. Accordingly, players are not informed of the prizes actually on sale and available to be won at a retail location, on a near real time, daily or other periodic basis.

Today, instant lottery games are sometimes discontinued because all the top-prize tickets in the game have been claimed by players, even though many tickets remaining for sale in the game still have value. For example, in most instant lottery games, a set of tickets is printed with play or prize value indicia under a scratch-off coating according to a predetermined prize structure. Typically, the prize structure consists of one or more large-value or 'top' prizes, a number of lesser value prizes and a large number of tickets that are not prize winners. The prize values in a game are imaged pseudo randomly on the tickets so that, in theory, each player has an equal chance to win one of the prizes.

In certain circumstances, however, problems arise as a game's tickets are sold and as the top prizes are claimed. For example, there have been complaints from customers that it is no longer possible to win one of the top prizes as advertised by the lottery administration in its general promotional literature. There are, for instance, certain lottery administrations in the United States that post on their web sites the remaining prizes within a game based on claimed winners, not on actual ticket sales. As the game is sold, the tickets having the various prizes are cashed, including the top prizes; and the lottery will update the website with the remaining prizes within the game. However, in many cases, the game will still have a significant number of winning tickets to be sold after the top prizes are cashed, yet the game loses appeal to customers. At other times a game may remain on sale because the last top-prize winning ticket has been sold but not claimed by a player. Or, the pack containing the prize may be languishing in the storage area of a retailer, forgotten and never offered for sale.

Historically the lottery game supplier has provided a lottery administration with just two prize structures. The first is the end of production prize structure which details information such as: the number of winners of each prize level, the number of non-winners, the odds of winning each prize, the overall odds of winning any prize, the minimum prize value per pack and the total value of the prizes delivered to the lottery. The second is the end of game prize structure that details all the prizes paid by the lottery following the end of sales of a game.

What is need in the industry is a system and method that provide a means to calculate an on-sale prize structure and to securely inform potential consumers of the prize value, number of winners and general availability of instant lottery game tickets currently on sale at retail locations to entice continued play of the game without jeopardizing integrity of the game or encouraging fraud. Where, the on-sale prize structure includes prizes from all packs that are available for sale from being loaded in a dispenser. The present invention addresses this need.

SUMMARY

Objects and advantages of the invention will be set forth in part in the following description, or may be obvious from the description, or may be learned through practice of the invention.

In accordance with aspects of the invention, a system is provided for dispensing instant or other preprinted lottery tickets at a retail establishment. The type of retail establishment may vary widely within the scope and spirit of the invention. For example, in certain embodiments, the retail establishments may be convenience stores, gas stations, pubs, and any other establishment that typically sells lottery tickets to the public. The present system has particular usefulness for much larger retail establishments, such as "big-box" retail stores that are part of a national or other geographic chain, wherein the sale of lottery ticket sales has generally not been implemented.

In certain embodiments, a lottery ticket terminal within the retail establishment is configured to accept a request for purchase of a particular lottery ticket selected from a plurality of different lottery tickets available at the retail establishment. A lottery ticket dispenser array is in communication with the lottery ticket terminal and includes a plurality of separate bins each having a pack of different respective lottery tickets stored therein. For example, the dispenser array may include ten separate bins, with each bin containing a pack of scratch-off lottery tickets, or two or more bins may contain a pack of tickets for the same game.

In certain embodiments, each lottery ticket contained in the bins includes a machine readable code printed thereon, such as a bar code, QR code, or the like. The lottery tickets may be pulled manually from the bins or, in a desirable embodiment, each bin in the array includes an electronic drive mechanism that, when activated, dispenses one or more lottery tickets from the bin (depending on the number of tickets requested by the patron). Each bin also includes a scanner disposed to read the code on lottery tickets dispensed from the bin position. In operation of the system, the lottery ticket terminal transmits a purchase signal for dispensing a particular lottery ticket that is routed to the respective bin containing the lottery ticket, which activates the drive mechanism to dispense the requisite number of tickets. As the tickets are dispensed from the bin, the scanner may read the code printed on each ticket, which eventually results in a signal being routed to the lottery central lottery server for each lottery ticket dispensed from the dispenser array. The code printed on each ticket contains identifying information unique to the ticket, and the signal transmitted to the central server enables actions relevant to determining the prize value of tickets remaining within the array, as discussed in greater detail below.

A scanner associated with each bin is disposed to read a code associated with the pack of lottery tickets upon loading of the pack of lottery tickets into the bin. This code may be, for example, a single code provided with the packaging of the ticket pack. In an alternate embodiment, the code may be the ticket code on the lead ticket inserted in the bin dispensing mechanism.

The central lottery server is in communication with each of the bins and is configured for receipt of the codes from the scanners. The central lottery sever is configured to: determine a total minimum winning prize amount of the lottery tickets in the pack associated with each bin; and generate and transmit a message that varies as a function of a total minimum prize amount of the lottery tickets remaining in all of the bins.

The system also includes a display at the retail establishment in communication with the central lottery server that receives and transmits the generated message to consumers.

A minimum determined prize amount is required for display to avoid the communication of information that would otherwise encourage winner pick-out at a particular retail location. For example, if there were only a few tickets on sale and the prize display indicated that the prizes available to be won, exceeded the retail value of all the tickets currently offered for sale, a customer or retail employee would be encouraged to buy all of the tickets currently on sale with a guaranteed profit.

The central lottery server may be in communication with a secure database that correlates winning lottery ticket prize amounts to specific lottery ticket packs. For example, this database (or the information contained in the database) may be generated at the time of printing of the tickets such that, at any given time, the central server can determine the prize amount for ticket packs currently on sale in the retail market and the geographic regions associated with the winning tickets. As winning tickets are dispensed (or redeemed), the central server can update the minimum prize amount displayed in the message provided to the consumers.

In a certain embodiment, it may be desired for the central lottery server to inform consumers via the message of the minimum prize amount for all tickets within an array without identifying particular bins within the array. Thus, when a customer enters a particular retail establishment, they are provided with the minimum prize amount for all tickets remaining in the array. If this prize amount is attractive, the consumer is likely to purchase one or more of the tickets from the array.

In an alternate embodiment, the relevant region is expanded beyond an individual array. For example, there may be a plurality of arrays at a number of different retail establishments within a defined geographic region, such as quadrant of a city, county, or other region. The central lottery server tracks the total on-sale prize amount for all of the arrays in the geographic region, and the message indicates to consumers the minimum prize amount of lottery tickets currently available for purchase within the geographic region. For example, upon entering one of the retail establishments within the geographic region, the consumer is informed by the message of the minimum prize amount of all tickets available at the different locations within the region. This embodiment may be enabled with the aid of a mobile application provided to the consumers that identifies the location of the retail establishments within the geographic region, wherein the central server provides information to the mobile application to update the minimum prize amount currently available for sale in the geographic region without identifying the amount associated with any particular retail establishment.

In still a further embodiment, the mobile application uses a consumer's GPS location provided by the consumer's smart device to tailor the application to a particular geographic region in which the consumer is located. The mobile application may also provide the minimum prize amounts available in geographic regions outside of the consumer's location. As the size of the region expands, the minimum prize amounts advertised can converge upon the actual total amount of prizes currently on sale with no risk of winner pick-out.

When operating in a mixed mode environment where all retail outlets are not equipped with automated dispensers, an estimated on-sale prize structure may be calculated based on packs activated for sale at other retail locations or loaded into conventional vending machines and winning tickets that have been claimed from such packs.

The present invention also encompasses various method embodiments associated with aspects discussed above. For example, a method is provided for dispensing lottery tickets at a retail establishment, and includes providing for purchase of the lottery tickets from a dispenser array in the retail establishment, the dispenser array including a plurality of separate bins having a pack of different respective lottery tickets stored therein. The dispenser array is configured in communication with a central lottery server. Upon loading of a ticket pack into the bins, the method includes scanning a code associated with the ticket pack and transmitting the code to the central lottery server. With the central lottery server, a minimum winning prize amount of the lottery tickets in the pack associated with each bin is determined. With this information, a message is generated and transmitted by the central server that varies as a function of a total minimum prize amount of the lottery tickets in all of the bins in the array. The method includes displaying the generated message at the retail establishment to consumers. For example, this message may inform consumers of the total minimum prize amount associated with all of the tickets in the particular array. Alternatively, the message may inform consumers of a total minimum prize amount associated with all arrays within a defined geographic location.

The method may further include periodically updating the generated message to reflect a change in the indicated value as—lottery tickets are dispensed. For example, a ticket code provided on each ticket may be scanned upon dispensing the tickets, wherein this code is transmitted to the central server. The central server uses the individual tickets codes to determine if the ticket is a winning ticket and, if so, the winning amount. This information may then be used to update the amount in the generated message.

In certain method embodiments, the geographic region and location of retail establishments within the geographic region are identified to consumers via a mobile application running on a consumer's mobile smart device, wherein the central server also provides information to the mobile application to periodically update the total minimum prize amount available in the geographic region. The mobile application may use a consumer's GPS location provided by the consumer's smart device to tailor the application to a particular geographic region in which the consumer is located.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

FIGS. 6A and 6B are illustrations of a typical end of production prize structure.

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
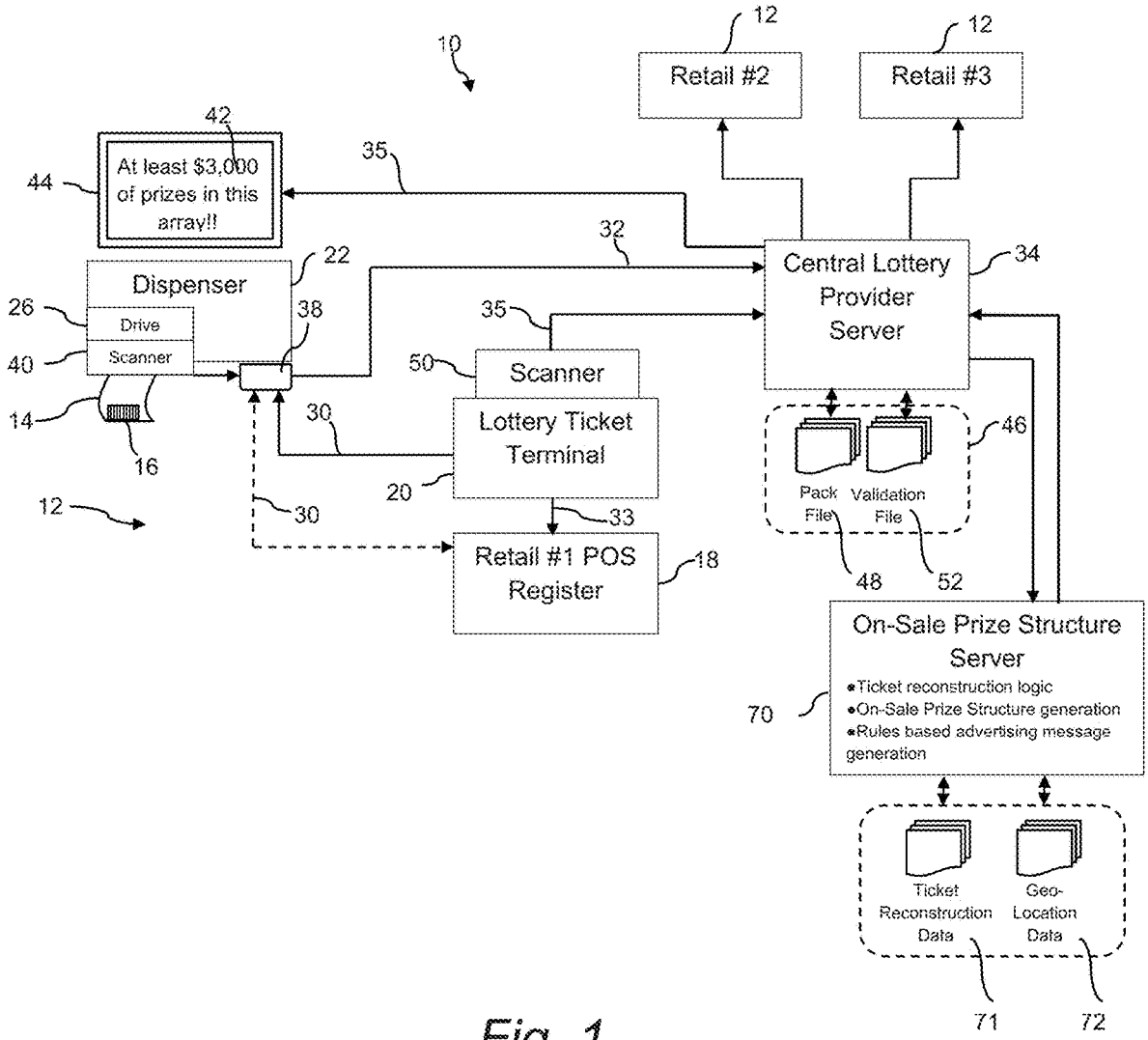
FIG. 1 is a block diagram of a system and associated methodology in accordance with aspects of the present invention.

FIG. 1 depicts an embodiment of a system 10 and related methodology for dispensing lottery tickets 14 at a retail establishment 12. As mentioned above, the type of retail establishment 12 may vary widely within the scope and spirit of the invention. A retail establishment or location 12, such as a retail store, convenience store, pub, restaurant, or the like, is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment 12 or lottery jurisdiction entities are not limiting factors of the invention.

Although not limited to such, the present system 10 may have particular usefulness for larger retail establishments, such as "big-box" retail stores that are part of a national or other geographic chain. In FIG. 1, three separate retail establishments 12 are depicted, with details given for one the establishments. This is for illustrative purposes only. It should be appreciated that the invention encompasses a single retail establishment 12, as well as a multitude of establishments 12, as discussed in greater detail below.

The retail establishment 12 includes one or more retail point-of-sale (POS) registers 18 wherein patrons of the establishment 12 purchase goods or services offered by the establishment. Typically, a scanner is associated with the POS register 18 to scan a UPC code on the products, with the UPC code linked to a purchase price and identification of the products, as is well-known in the art.

In the embodiment of FIG. 1, a lottery ticket terminal 20 is provided, which may be remote from the POS register 18 or at the same location. In certain embodiments, it may be desired to configure the POS register 18 in wired or wireless communication with the retail POS register 18 to accept a request 30 for purchase of a particular lottery ticket 14 selected from a plurality of different lottery tickets made available to patrons for purchase. This request 30 may be input directly to the terminal 20 or come via the POS register 18. The lottery ticket terminal 20 is in wired or wireless communication 35 with a central lottery server 34.

The lottery tickets 14 may be, for example, conventional instant scratch-off lottery tickets. Various types of lottery ticket terminals are known in the art and suitable for configuration with a system 10 in accordance with the invention. For example, Scientific Games Corporation having a principal place of business in Alpharetta, Ga., USA, offers Flair™ and Wave™ lottery ticket terminals that may be readily configured by those skilled in the art for a system as described herein. A patron's request for a particular scratch-off lottery ticket may be inputted into the lottery ticket terminal 20 by a retail clerk or other employee of the retail establishment 12 by various means. For example, the terminal 20 may be configured with a scanner 50, wherein the clerk scans a "master" card having a code, such as a UPC, corresponding to the particular lottery ticket 14 requested by the patron. Thus, a master card would be provided for each type of lottery ticket 14 offered by the establishment 12. In another embodiment, the terminal 20 may be configured with a touch-screen, keyboard, or other data input device, wherein the clerk enters or identifies the ticket 14 requested by the patron.

Figure 3:
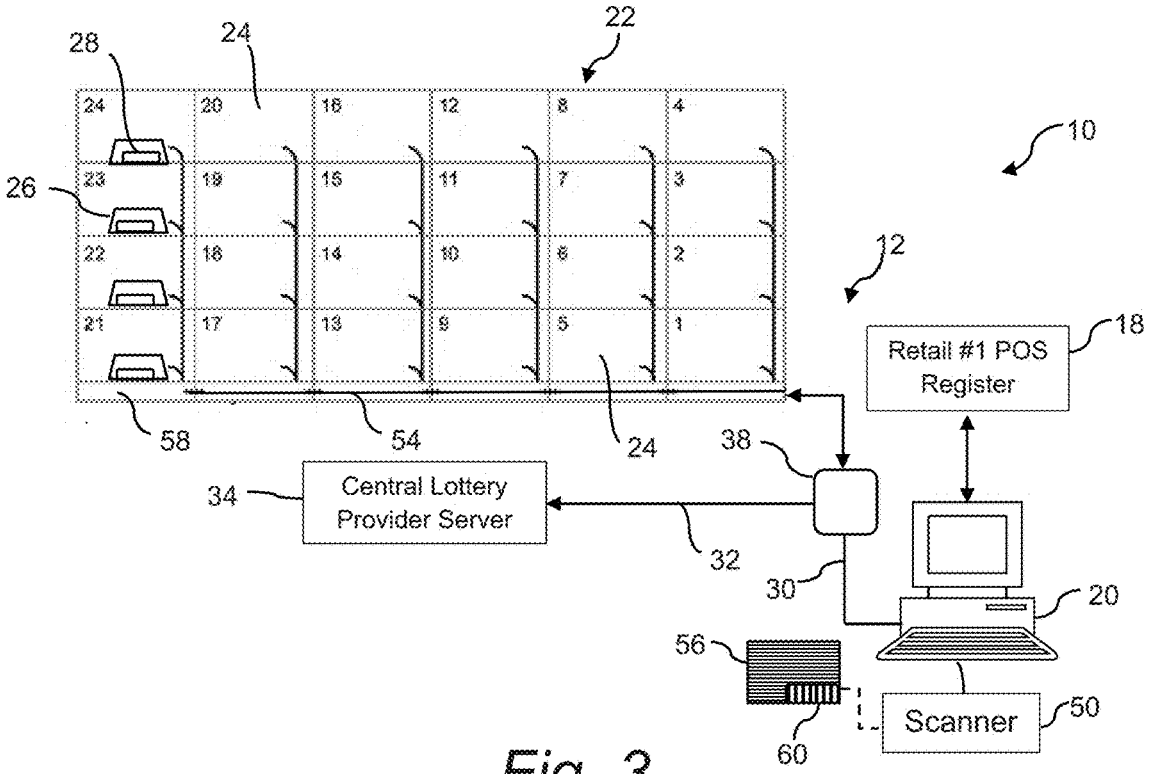
FIG. 3 is a block diagram of a lottery ticket dispenser in accordance with aspects of the present invention.

Still referring to the embodiment of FIG. 1, a "smart" lottery ticket dispenser array 22 is in wired or wireless communication with the terminal 20. This dispenser array includes one or a plurality of individual lottery ticket bins 24, as shown in FIG. 3, with each bin 24 typically containing a different respective lottery ticket game. For example, one bin 24 may contain "Lucky 7" themed scratch-off lottery tickets 14, while an adjacent bin 24 may contain "Gold Rush" themed scratch-off lottery tickets 14, and so forth.

Returning to FIG. 1, each lottery ticket 14 in the different bins typically includes a machine readable code 16 printed thereon, such as a bar code, QR code, or the like. The type of code 16 may vary depending on the desired information content of the code 16, space on the ticket 14, and so forth. The use of such codes 16 on lottery tickets 14 for various functions related to inventory, identification, verification, and security are well-known.

Figure 2:
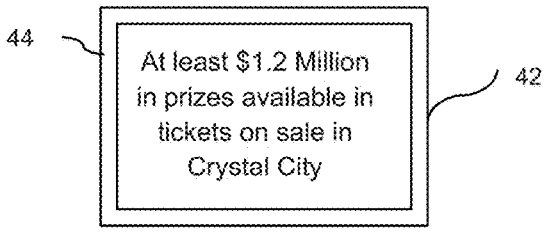
FIG. 2 is a depiction of a display device and associated message.

Referring to FIGS. 1 and 2, in certain of the system embodiments, each bin 24 in the dispenser array 22 includes an electronic drive mechanism 26 that, when activated, dispenses one or more lottery tickets 14 from the bin 24 (depending on the number of tickets requested by the patron). This drive mechanism 26 may include a motor that drives a friction roll, wherein the tickets 14 are engaged between the friction roll and an idler roll such that driven rotation of the friction roll causes the tickets 14 to be advanced through a dispensing slot in a wall of the individual bin 24. The drive mechanism 26 may also include a sensor 28 that detects a leading and/or trailing edge of adjacent tickets so as to control the length or the time of the dispense sequence. For example, such a sensor may detect a perforation line between adjacent tickets. Alternately, the friction or idler roll may include an encoder that indirectly measures the length of a ticket passing between the rolls as a function or rotations of the roll. In another embodiment, a timing circuit may control the dispense cycle as a function of run time of the motor. It should be appreciated that the drive mechanism may be variously configured to perform the functions of dispensing the requisite number of tickets 14 from the individual respective bin 24 within the scope and spirit of the invention.

In the illustrated embodiments, each bin 24 also includes a scanner 40 disposed so as to read the code 16 on the lottery tickets 14 as they are dispensed from the bin 24. The scanner 40 may be any conventional barcode reader, such as a point scanner, linear scanner, laser scanner, LED image scanner, and so forth. The tickets 14 are loaded into the bins 24 such that the code 16 printed on each ticket passes within the detection field of the scanner 40. An integral (or separate) processor is configured with the scanner 40 to decode the scanner signal.

In operation of the system 10 depicted in FIGS. 1 and 3, the lottery ticket terminal 20 transmits a purchase signal 30 for dispensing a particular lottery ticket 14 that is routed to the respective bin 24 within the dispenser array 22 containing the requested lottery ticket. This purchase signal 30 may be sent to a bin controller 38 associated with the dispenser array 22, with the controller 38 generating a dispense signal that is routed to the proper bin 24 to activate the drive mechanism 26 and dispense the requisite number of lottery tickets 14 from the bin 24. In essence, the bin controller 38 functions as a signal router for the array 22 that ensures that the signal 33 is routed to the correct bin 24.

FIG. 1 depicts an alternate embodiment wherein the purchase signal 30 is generated by the POS register 18 and transmitted to the bin controller 38 after the POS register 18 receives a purchase code 33 from the lottery ticket terminal 20 corresponding to the particular ticket requested by the patron. In an alternate embodiment, the POS register 18 can generate the purchase code 33 after reading a UPC code from a master card for the selected game.

As the tickets 14 are dispensed from the bin 24, the scanner 40 reads the code 16 printed on each ticket. A signal 32 corresponding to the scanned code is generated and routed to a central lottery server 34 for each lottery ticket dispensed from the dispenser array 22. In the embodiment of FIG. 1, this signal 32 is generated and transmitted by the bin controller 38. In other embodiments, the lottery ticket terminal 20 could receive the scanned code from the bin controller 38 and transmit the signal 32 via communication path 35 to the central lottery server 34. As mentioned, the code 16 printed on each ticket contains identifying information unique to the ticket, much akin to a serial number assigned to each ticket, and the signal 32 transmitted to the central server 34 enables actions relevant to the present method and systems, as discussed in greater detail below.

FIG. 1 depicts the central lottery server 34 that is common to a plurality of the retail establishments 12. The term "server" is used herein to encompass any configuration of computer hardware and software that is maintained by a lottery authority or game provider to carry out the functionalities of the present system 10 and associated method, as well as any manner of additional lottery functions known to those skilled in the art. It should be readily appreciated that the server 34 may include an integrated server, or any manner of periphery server or other hardware structure. The central lottery server 34 is typically remote from the retail establishments 12, and is in communication with the establishments 12 via a suitable secure communication network, which may include any manner of wide area network, wireless internet, or cloud computing. The server 34 may be a single networked computer, or a series of interconnected computers having access to the communications network via a gateway or other known networking system. This is illustrated by the On-Sale Prize Structure Server, 70. Generally, the server 34 is configured to communicate with, manage and control individual lottery terminal units 20 within the lottery jurisdiction. The server 34 may be a "front end" server provided by the lottery game provider that is interfaced with the existing draw/instant game system infrastructure one or more separate lottery authorities. The server 34 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 100.

The server 34 may be directly or indirectly connected through an I/O bus to any manner of peripheral devices such as storage devices, wireless adaptors, printers, and the like. In addition, a database (DB), such as the On-Sale Prize Structure Server, 70, may be communicatively connected to the server 34 and provide a data repository for the storage and correlation of information gathered from the individual dispenser arrays 22, such as the identity of each lottery ticket 14 dispensed from the array, the time of the dispense sequence, confirmation of ticket activation, geo-location data 72, for retail outlets, ticket reconstruction data for determination of certain prize values of tickets currently on sale, 71 and so forth.

It should be appreciated that embodiments of the methods and systems 10 disclosed herein may be executed by one or more suitable networked lottery gaming components and establishment components (e.g., POS register 18, retail back office servers, and the like) within a plurality of the establishments 12, as well as the remote central server 34. Such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

As mentioned above, aspects of the present system 10 and methods rely on the transmission of data over one or more communications networks. It should be appreciated that network communications can comprise sending and/or receiving information over one or more networks of various forms. For example, a network can comprise a dial-in, public switched telephone network (PSTN), a local area network (LAN), wide area network (WAN), the Internet, an intranet or other type of network. A network may comprise any number and/or combination of hard-wired, wireless, or other communication links.

A scanner is associated with each array 22 or bin 24 to read a code associated with the pack 56 (FIG. 3) of lottery tickets upon loading of the pack 56 of lottery tickets into the array 22. Referring to FIG. 3, this code may be, for example, a single code 60 provided with the packaging of the ticket pack. With this embodiment, a scanner 50 provided at or near the lottery terminal 20 may be used to scan the ticket pack code 60 and transmit the code 60 directly to the lottery central server 34 or through the bin controller 38. In an alternate embodiment, the code may be the ticket code 16 on the lead ticket 14 in the pack, which can be scanned by the scanner 28 associated with each bin and transmitted to the lottery central server 34 via the bin controller 38. For purposes of the present invention, it is not absolutely necessary that the individual bin 24 in which new ticket packs 56 are loaded be identified, but only the bin array 22. Thus, it many embodiments, the scanner 50 that is not associated with any particular bin 24 within the array 24 will suffice for this purpose.

The central lottery server 34 is configured to perform certain functions in accordance with aspects of the present method/system 10. As mentioned, the server 34 is in communication with each of the bins 24 and is configured for receipt of the lottery ticket codes 16 from the scanners 28 associated with each bin 24 as the lottery tickets 14 are dispensed.

Server 70 executes software that determines certain prize values of tickets on sale at the retail locations, groups of retail locations, and across the entire lottery jurisdiction. In doing so, the server 70 uses the ticket serial numbers in conjunction with the reconstruction data 71 and geo-location data 72 to construct various marketing messages to be displayed in retail locations, on player smart phones and lottery websites regarding certain prize values of games on sale, without disclosing information that could contribute to winner pick-out by players, retailer employees, as well as lottery supplier and lottery personnel. This is accomplished by only returning aggregate data on large groups of tickets being offered for sale. The larger the top prize is that is included in such an aggregation, the larger the group of dispenser arrays must be that are included in such a group. For example, FIGS. 6A and 6B show a typical prize structure for an instant lottery game, including the odds associated with wining any prize in a game and the unique arrangement of low tier winners contained in different packs of tickets. With this particular game structure, there are 7 ways to win $100 with 330 tickets winning a $100 prize out of 300,000 tickets in the game. This establishes the overall odds of winning a $100 prize at 1 chance in 909 tickets. Accordingly, if the system were to convey information disclosing the presence of a $100 prize in a group of fewer than 909 tickets from this game, then information advantageous to the purchaser would have been disclosed. Similar calculations for each category of winning tickets must be made to determine the rules for prize disclosure for any retail location, group of retailers or geographic region for which information concerning prizes on sale are to be disclosed. Such logic must execute on the prize structure server 70, to insure the fairness of the lottery games on sale.

It should be appreciated that the process described above for determining the total minimum prize amounts of the packs on sale in array 22 at retail location 12 or groups of retail locations 62 is for illustrative purposes only. The process can be modified depending on the type and location of information available to the central lottery server 34, on-sale prize server 70, types of databases 71 and 72, security measures, and so forth.

Each book of tickets placed on sale at a retail location has at least a minimum prize structure value. For example, FIG. 6B illustrates examples of low-end prize structures that may be used for each book of tickets. Structure A guarantees that each book of 30 tickets contains 8 winning tickets for a total minimum prize value of $165. Structure B indicates a minimum of 9 winning tickets in a book of 30 tickets for a minimum prize value of $165. The other structures C through E are readily understood. Based on knowledge of these minimum prize value structures and the number of books initially placed in a dispenser array (and activated for sale), the system 34, 70 can readily calculate an initial minimum prize value for any individual dispenser array 22, or group of arrays 22 within a defined geographic location.

As tickets are dispensed from an array 22, the system can compute an approximation of the remaining minimum prize value for a dispenser array 22 without identifying any particular bin 24 within the array 22. In one embodiment, this calculation may be based on a percentage of tickets remaining for sale in the array 22. As discussed above, as individual tickets are dispensed from the various bins 24, the code/number unique to each ticket is transmitted to the central provider server 34/on-sale prize structure server 70, which can near-instantaneously compute the number of tickets dispensed from any given dispenser. A simple ratio or percentage can then be applied to approximate the remaining total minimum prize value. For example, if 30% of the tickets have been dispensed from an array 22 and the winning tickets are randomly distributed throughout a pack, a reasonable approximation is that 70% of the initial total minimum prize value remains in the array 22.

In an alternate embodiment, the approximation may be based on historical data, such as history of low-tier winner casing activity. Once a low-tier winning ticket has been cased, ticket reconstruction data can be generated to determine the particular pack that contained the ticket, wherein the packs are correlated to particular bins, as discussed above. Based on this cashing activity, a reasonable approximation can be made as to the remaining minimum prize value for any given dispenser.

Another method may relay time-based historical data that correlates time after a pack has been placed in an array for sale with remaining minimum prize value. For example, immediately after activating the pack for sale, 100% of the minimum prize value is in the pack. After one month, historical data may indicate that 30% of the tickets are typically sold. Thus, based on time alone, an approximation can be made that, at the one month point, 70% of the tickets remain (and 70% of the minimum prize value). This historical data can be fine-tuned for specific retailer locations of broader regions encompassing multiple retailer locations.

The central lottery server also generates and transmits a message 42 that varies as a function of a total minimum prize amount of the lottery tickets 14 in all of the bins 24 at the retail location 12, for example all of the bins 24 within the array(s) 22 located in the retail establishment 12. This message 42 may be print, video, audio, or any combination thereof, and is displayed on a suitable device 44 located in or near the retail establishment 12, for example at or near the lottery ticket array 22. The display device 44 may be a video screen or monitor, rolling electric banner, speakers, or the like. The type of message 42 and associated display device can vary widely within the scope and spirit of the invention.

As illustrated in the figures, the message 42 conveys to consumers how a minimum value of the prize money still available from tickets 14 in the particular array 22, or in a grouping of arrays 22 that includes the particular array 22 at which the message is broadcast, without identifying any particular bin within the array. For example, in the embodiment of FIG. 1, the message 42 identifies that at least $3,000 of prize money remains in the array 22 without identifying any particular bin 24. Thus, when a customer enters a particular retail establishment 12, they are provided with the total minimum prize amount remaining for all tickets still in the array 22. If this prize amount is attractive, the consumer is likely to purchase one or more of the tickets from the array.

In an alternate embodiment described in greater detail below, the message 42 may indicate a remaining minimum prize amount remaining in tickets 14 still available for sale in a defined geographic region, such as a town or city, shopping district, quadrant of a map, and so forth, as depicted by the message 42 in FIG. 2. In this embodiment, when the remaining minimum prize amount changes for tickets still available at any one of the locations 12, the message 42 will change at all of the locations.

The central lottery server 34 may also be configured to periodically update the various messages 42 as the available minimum prize awards change (e.g., decrease) over time, as discussed above.

Figure 4:
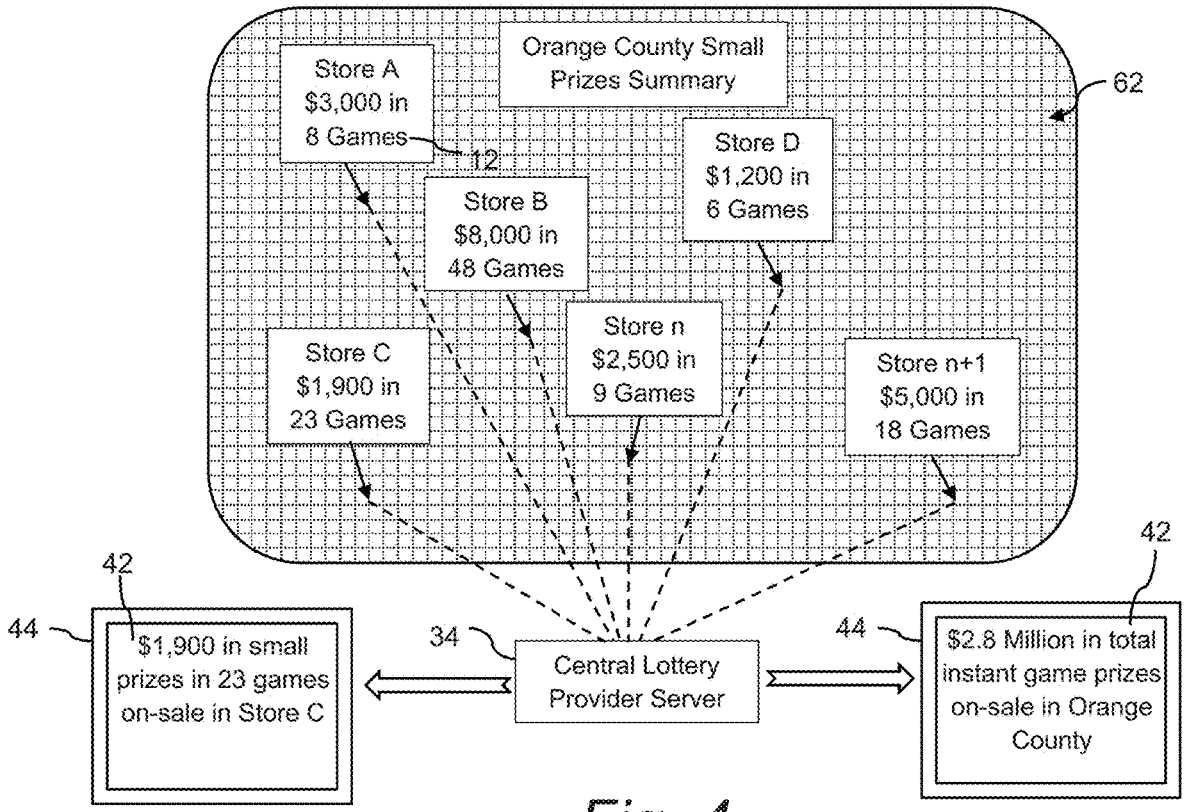
FIG. 4 is an operational diagram of certain aspects in accordance with the invention.

Referring for example to FIG. 4, in an alternate embodiment, the relevant region associated with the message 42 is expanded beyond an individual array 22 or individual retail location 12. For example, there may be a plurality of arrays at a number of different retail establishments within a defined geographic region 62, such as quadrant of a city, county, or other region. The central lottery server 34 tracks the remaining total prize amount for all of the arrays in the geographic region 62, and the message 42 indicates to consumers the total prize amount of lottery tickets still available for purchase within the geographic region 62 without identifying the amount available at any particular establishment 12 within the region 62. For example, upon entering one of the retail establishments 12 within the geographic region 62, the consumer is informed by the message 42 (right-hand message in FIG. 4) of the total minimum prize amount for all tickets available at the different locations 12 within the region 62. Alternatively, the message 42 (left-hand message in FIG. 4) may indicate the remaining minimum prize amount in any one or all of the retail locations 12 within the region.

Figure 5:
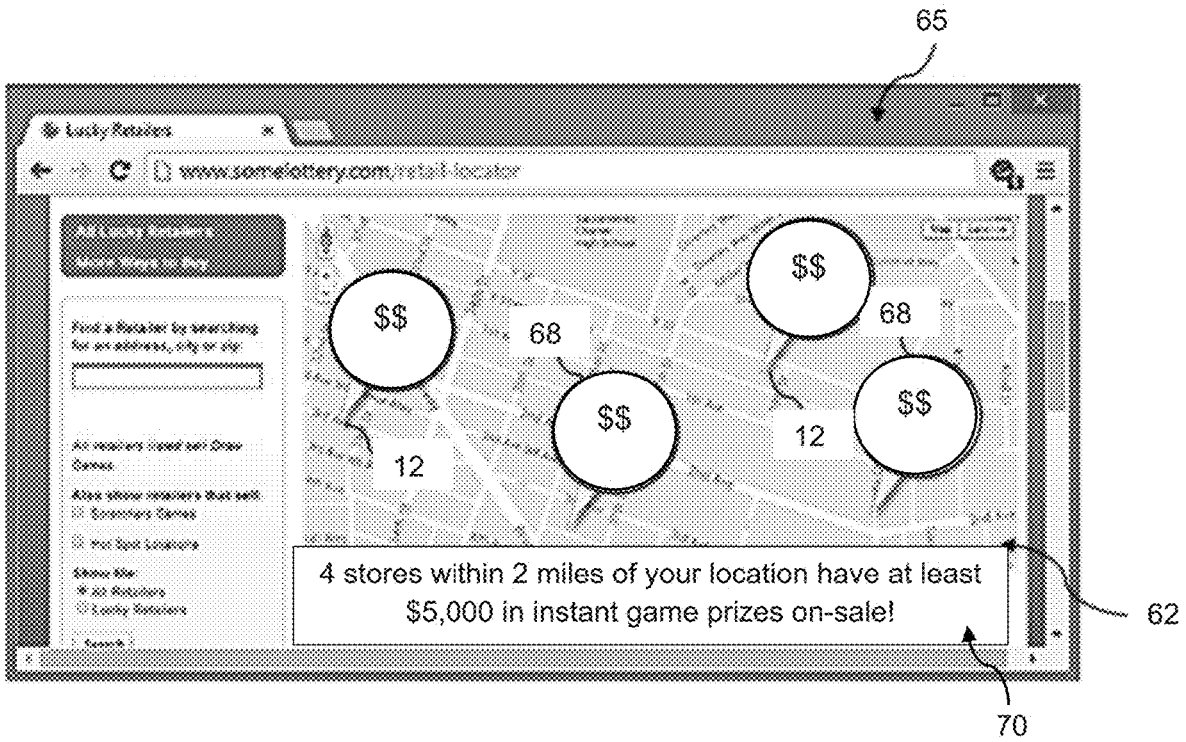
FIG. 5 is a screen shot view depicting features of the present method.

Referring to the screen shot of FIG. 5, certain embodiments may be enabled with the aid of a mobile application 65 provided to the consumers that identifies location of the retail establishments 12 within the geographic region 62 by the use of icons 68 or other means, wherein the central server 34 provides information to the mobile application to update the total prize amount available in the geographic region without identifying the amount associated with any particular retail establishment. A personalized message 70 may be generated and displayed to the consumer with such information. In a particular embodiment, the mobile application uses a consumer's GPS location provided by the consumer's smart device to tailor the application to a particular geographic region 62 in which the consumer is located. The mobile application may also provide the total prize amounts available in geographic regions outside of the consumer's location.

The present invention also encompasses various method embodiments associated with aspects discussed above. For example, a method is provided for dispensing lottery tickets 14 at a retail establishment 12, and includes providing for purchase of the lottery tickets from a dispenser array 22 in the retail establishment 12, the dispenser array 22 including a plurality of separate bins 24 having a pack 56 of different respective lottery tickets 14 stored therein. The dispenser array 22 is configured in communication with a central lottery server 34. Upon loading of a ticket pack 56 into the bins, the method includes scanning a code 60 associated with the ticket pack 56 and transmitting the code to the central lottery server 34. With the central lottery server 34 (which includes the prize structure server 70), a total minimum winning prize amount of the lottery tickets 14 in the pack associated with each bin 24 is determined. With this information, a message 42 is generated and transmitted by the central server 34 that varies as a function of remaining total minimum prize amount of the lottery tickets in all of the bins 24 in the array 22. The method includes displaying the generated message 42 at the retail establishment 12 to consumers via any suitable display device 44. For example, this message 42 may inform consumers of the total prize amount associated with all of the tickets 14 in the particular array 22. Alternatively, the message may inform consumers of the total prize amount associated with all arrays within a defined geographic location 62.

The method may further include periodically updating the generated message 42 to reflect a change in the indicated minimum prize value as winning lottery tickets are dispensed, as discussed above.

In certain method embodiments, the geographic region 62 and location of retail establishments 12 within the geographic region 62 are identified to consumers via a mobile application 65 running on a consumer's mobile smart device, wherein the central server 34 also provides information to the mobile application to periodically update the total prize amount available in the geographic region 62. The mobile application may use a consumer's GPS location provided by the consumer's smart device to tailor the application to a particular geographic region in which the consumer is located.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for dispensing lottery tickets at a retail establishment, wherein the lottery tickets are contained in a lottery ticket dispenser array that is in communication with a lottery ticket terminal, the array having a plurality of bins with each bin having a pack of the lottery tickets stored therein, the method comprising:

assigning a predetermined prize value to each lottery ticket in the pack of lottery tickets;

assigning each pack of lottery tickets with a predetermined minimum prize value structure based on a number and prize value of winning lottery tickets in the pack of lottery tickets;

providing each pack of lottery tickets with a scannable pack code that identifies the predetermined minimum prize value structure for the pack of lottery tickets, wherein the pack code is scannable by a vendor upon loading of the pack of lottery tickets into a bin of the plurality of bins;

generating, transmitting and, as the lottery tickets are dispensed from the bins, updating a message that indicates a total minimum prize amount for all remaining lottery tickets in all of the bins within the array using the predetermined minimum prize value structure for each pack of lottery tickets within the array without identifying particular ones of the bins in which the winning lottery tickets remain;

wherein the total minimum prize amount is a potential prize amount attributed only to the array based solely on purchase of lottery tickets contained in the array; and displaying the message at the retail establishment so that consumers at the retail establishment are informed of the total minimum prize amount attributed to the lottery tickets remaining in the array prior to purchase of one or more of the lottery tickets from the array.

2. The method as in claim 1, wherein each lottery ticket contains a machine readable code thereon that is scanned upon dispensing the lottery ticket, the codes from dispensed lottery tickets used to periodically generate an updated version of the message as the lottery tickets are dispensed from the array.

3. The method as in claim 2, wherein a central server in communication with the lottery ticket terminal or a controller associated with the array to generate and update the message.

4. The method as in claim 1, wherein the pack code is a single bar code associated with each pack of lottery tickets, the single bar code scanned prior to loading of the pack of lottery tickets into the bin.

5. The method as in claim 1, wherein the pack code is a machine readable code on a lead lottery ticket of each pack of lottery tickets scanned at a time of loading of each pack of lottery tickets into the bin.

6. The method as in claim 1, wherein the array is associated with a plurality of other arrays at other retail establishments in a defined geographic region, the method further tracking the total minimum prize amount for all of the arrays in the geographic region, and the message further indicating to the consumers the total minimum prize amount remaining for all of the lottery tickets still available for purchase within the geographic region.

7. The method as in claim 6, further comprising, via a mobile application provided to the consumers, identifying a location of the retail establishments within the geographic region and providing the total minimum prize amount available at the retail establishments within the geographic region.

8. The method as in claim 7, wherein the mobile application uses a GPS location of a mobile device of an individual consumer running the mobile application to tailor the mobile application to a particular geographic region in which the individual consumer is located.

9. The method as in claim 8, wherein the mobile application also displays the total minimum prize amount available in other geographic regions.

* * * * *